United States Patent [19]

Herbert, Jr. et al.

[11] Patent Number: 4,678,691

[45] Date of Patent: Jul. 7, 1987

[54] ELECTROFORMING PROCESS AND PRODUCT

[75] Inventors: William G. Herbert, Jr., Williamson; Henry G. Grey, Webster; Bruce C. Reynolds, Rochester, all of N.Y.

[73] Assignee: Xerox Corporation, Stamford, Conn.

[21] Appl. No.: 791,043

[22] Filed: Oct. 24, 1985

[51] Int. Cl.[4] ..... B41C 3/08; B32B 31/00

[52] U.S. Cl. ..... 428/36; 204/6; 156/499

[58] Field of Search ..... 428/36; 204/6, 9; 156/499, 584

[56] References Cited

U.S. PATENT DOCUMENTS

| | | | |
|---|---|---|---|
| 3,844,906 | 10/1974 | Bailey et al. | 204/9 |
| 3,905,400 | 9/1975 | DuPree et al. | 138/140 |
| 3,927,463 | 12/1975 | Dupree et al. | 29/447 |
| 3,950,839 | 4/1976 | DuPree et al. | 29/447 |
| 4,326,928 | 4/1982 | Dugan | 204/9 |
| 4,461,663 | 7/1984 | Tachibana et al. | 156/86 |
| 4,501,646 | 2/1985 | Herbert | 204/4 |
| 4,549,923 | 10/1985 | Tachibana et al. | 156/423 |

*Primary Examiner*—John E. Kittle

*Assistant Examiner*—Patrick J. Ryan

*Attorney, Agent, or Firm*—Peter H. Kondo

[57] ABSTRACT

A composite metal article is disclosed comprising at least a first elongated electroformed hollow member and a second electroformed elongated hollow member, each of the hollow members comprising at least a first sleeve and a second sleeve, one sleeve of each of the hollow members having a perimeter larger than the perimeter of the other sleeve of the same member, at least a segment of the outer surface of one sleeve of the second elongated hollow member being adjacent to and substantially surrounded by the inner surface of one sleeve of the first elongated hollow member. This composite hollow member may be formed by electroforming the hollow members on two appropriately shaped mandrels, removing the hollow members from the mandrels, and inserting at least a segment of the hollow member from one mandrel inside at least a segment of the hollow member from the other mandrel whereby the inner surface of at least a segment of the hollow member from one mandrel substantially surrounds at least a segment of the outer surface of the hollow member from the other mandrel.

15 Claims, 7 Drawing Figures

42
44
40
46

58
50
56
52
54

ELECTROFORMING PROCESS AND PRODUCT

BACKGROUND OF THE INVENTION

This invention relates in general to an electroforming process and a hollow composite article prepared by the electroforming process.

The fabrication of hollow articles by an electroforming process is well known. For example, seamless tubes may be fabricated by electrodepositing a metal or metal alloy onto a cylindrically shaped mandrel which is suspended in an electrolytic bath. The seamless electroformed tubes are thereafter removed from the mandrel by sliding the tube off one end of the mandrel. Different techniques have been developed for forming and removing tubes from electroforming mandrels depending upon the cross-sectional area of the electroformed tube. Examples of these techniques are described, for example, in U.S. Pat. No. 3,844,906 to R. E. Bailey et al and in U.S. Pat. No. 4,501,646 to W. G. Herbert.

A process for electroforming hollow nickel articles having a large cross-sectional area onto a mandrel is described in U.S. Pat. No. 3,844,906 to R. E. Bailey et al. More specifically, the process involves establishing an electroforming zone comprising a nickel anode and a cathode comprising a support mandrel, the anode and cathode being separated by a nickel sulfamate solution maintained at a temperature of from about 140° F. (60° C.) to 150° F. (65° C.) and having a current density therein ranging from about 200 to 500 amps/ft$^2$ (20 to 50 amps/dm$^2$) imparting sufficient agitation to the solution to continuously expose the cathode to fresh solution, maintaining this solution within the zone at a stable equilibrium composition comprising:

Total Nickel: 12.0 to 15.0 oz/gal

Halide as $NiX_2.6\ H_2O$: 0.11 to 0.23 moles/gal $H_3BO_3$: 4.5 to 6.0 oz/gal electrolytically removing metallic and organic impurities from the solution upon egress thereof from the electroforming zone, continuously charging to the solution about 1.0 to $2.0\times10^{-4}$ moles of a stress reducing agent per mole of nickel electrolytically deposited from the solution, passing the solution through a filtering zone to remove any solid impurities therefrom, cooling the solution sufficiently to maintain the temperature within the electroforming zone upon recycle thereto at about 140° F. (60° C.) to 150° F. (65° C.) at the current density in the electroforming zone, and recycling the solution to the electroforming zone.

The thin flexible endless nickel belt formed by this electrolytic process is recovered by cooling the nickel coated mandrel to effect the parting of the nickel belt from the mandrel due to different respective coefficients of thermal expansion.

For metal articles fabricated by electroforming on mandrels having a small cross-sectional area, the process described in U.S. Pat. No. 4,501,646 to W. G. Herbert is preferred to overcome difficulties in removing the electroformed article from the mandrel. For example, when the chromium coated aluminum mandrel described in U.S. Pat. No. 3,844,906 is fabricated into electroforming mandrels having very small diameters of less than about 1 inch, metal articles electroformed on these very small diameter mandrels are extremely difficult or even impossible to remove from the mandrel. Attempts to remove the electroformed article can result in destruction of damage to the mandrel or the electroformed article, e.g. due to bending, scratching or denting.

Normally, hollow electroformed articles such as metal tubes are removed from one end of an electroforming mandrel and are finished by trimming each end. If the electroformed tubes are to be utilized as shafts, the ends of the tubes must normally be fitted with collets, press fit bearings or other devices which will allow the ends of the shaft to be supported by rods, bearings and the like. Although the formation of hollow members by means of electroforming is relatively economical, additional cost and manufacturing steps are required to trim the ends of the electroformed articles and to insert collets, bearings, or other support devices. Moreover, the structural strength of the resulting assembly is only as strong as the strength of the thin wall of the electroformed article.

SUMMARY OF THE INVENTION

It is an object of the invention to provide an electroforming process and product thereof which overcomes the above-noted disadvantages.

It is another object of this invention to provide an electroforming process and article thereof that reduces the number of manufacturing steps.

It is still another object of this invention to provide an electroforming process which forms articles thereof having improved dimensional tolerances.

It is another object of this invention to provide an electroformed article which exhibits greater resistance to dimensional distortion under stress.

It is another object of this invention to provide an electroformed article which exhibits greater versatility in resisting harsh environmental conditions while retaining resistance to dimensional distortion under stress.

It is another object of this invention to provide an electroforming process and product thereof which is both simple and inexpensive.

The foregoing objects and others are accomplished in accordance with this invention by providing a composite metal article comprising at least a first elongated electroformed hollow member and a second electroformed elongated hollow member, each of the hollow members comprising at least a first sleeve and a second sleeve, one sleeve of each of the hollow members having a perimeter larger than the perimeter of the other sleeve of the same member, at least a segment of the outer surface of one sleeve of the second elongated hollow member being adjacent to and substantially surrounded by the inner surface of one sleeve of the first elongated hollow member. This composite hollow member may be formed by providing a first elongated electroforming mandrel and a second elongated electroforming mandrel, each of the mandrels having a first end and a second end and a substantially circumferential electroforming surface extending from about the first end along the length of each of the mandrels to substantially the second ends, the perimeter of the electroforming surface adjacent the first end of each of the mandrels being smaller than the perimeter of the remaining electroforming surface on each of the mandrels, the outside perimeter of at least one segment of the electroforming surface of the second elongated electroforming mandrel being sufficiently smaller than the inside perimeter of at least one segment of the electroforming surface of the first elongated electroforming mandrel whereby a hollow metal article electroformed on the second elongated electroforming mandrel is adapted to slide into the hollow interior of a hollow metal article electroformed on the first elongated electroforming mandrel, electroforming a hollow article on the electroforming surface of the first mandrel, electroforming a hollow article on the electroforming surface of the second mandrel, each of the articles corresponding to the electroforming surface of the respective mandrels, removing the hollow articles from the mandrels, and inserting at least a segment of the hollow article from the second elongated mandrel inside at least a segment of the hollow article from the first elongated mandrel whereby the outer surface of at least a segment of the hollow article from the second elongated mandrel is substantially surrounded by at least a segment of the inner surface of the hollow article from the first elongated mandrel.

A more complete understanding of the processes and articles of the present invention can be obtained by reference to the accompanying drawings wherein:

FIG. 1 schematically illustrates a composite metal article.

FIG. 2 schematically illustrates an end view of one end of the composite article shown in FIG. 1.

FIG. 3 schematically illustrates an end view of another end of the composite article of FIG. 1.

FIG. 4 schematically illustrates an end view of another embodiment of a composite article.

FIG. 5 schematically illustrates an end view of still another embodiment of a composite article.

FIG. 6 schematically illustrates a sectional view of still another embodiment of a composite article.

FIG. 7 schematically illustrates a sectional view of still another embodiment of a composite article.

The advantages of this invention will become more apparent upon a consideration of the following disclosure of this invention, particularly when taken in conjunction with the following Figures.

In FIG. 1, a composite metal article 10 is illustrated comprising a first elongated electroformed hollow member 12 and a second electroformed elongated hollow member 24. The first elongated electroformed hollow member 12 comprises a first sleeve 16 having an outer perimeter larger than the outer perimeter of a second sleeve 18. Similarly, the second electroformed elongated hollow member 24 comprises a first sleeve 20 having an outer perimeter larger than the outer perimeter of a second sleeve 22. At least a segment of the outer surface of the first sleeve 20 of the second elongated hollow member 24 is adjacent to and substantially surrounded by at least a segment of the inner surface of the first sleeve 16 of the first elongated hollow member 12. Although the first sleeves 16 and 20 are illustrated as having a circular cross section, either or both may have any other suitable configuration such as an oval, polygon such as a triangle, square, rectangle, hexagon, octagon, figure having a scalloped pattern and the like. The cross section may be regular in shape or irregular, (e.g. trapezoid) so long as first sleeve 20 can be inserted within first sleeve 16 so that at least a segment of the first sleeves overlap and contact is established between at least part of the outer surface of the first sleeve 20 of the second elongated hollow member 24 and at least part of the inner surface of the first sleeve 16 of the first elongated hollow member 12. Thus, if desired, the cross-sectional shape of one or both of the first and second elongated electroformed hollow members may be unsymmetrical. For example, the cross-sectional shape may take the form of a cam, egg, pear, horseshoe and the like. Moreover, the general shape of the first sleeve of the first elongated electroformed hollow member need not correspond to the general shape of the first sleeve of the second electroformed elongated hollow member. For example, the first sleeve of the first elongated electroformed hollow member may have a toothed gear cross-sectional shape and the first sleeve of the second electroformed elongated hollow member may have a cross-sectional circular shape or vice versa. In this example, sufficient surface area of the outer surface of the first sleeve of the second electroformed elongated hollow member should contact sufficient surface area of the inside surface of the first sleeve of the first elongated electroformed hollow member to provide adequate support for the intended application. For concentric relationships between the axis of the hollow members, at least three circumferential points of contact are normally employed. If three points of contact are employed for maintaining concentricity, the points of contact are preferably about 120° apart. The cross-sectional dimensions of the first sleeves of both electroformed hollow members should allow the first sleeve of the smaller electroformed hollow member to slide into the first sleeve of the larger electroformed member. At least two points of contact are usually required to lock the overlapping sleeves together. A single point of contact could lock overlapping sleeves if an adhesive, weld, solder and the like are utilized.

The longitudinal configuration of first sleeves 16 and 20 may be selected from the same or different shapes. Further, combinations of shapes such as a shallow cone shape combined with a right cylinder shape for each individual electroformed elongated hollow member can be used for each first sleeve where suitable. The shapes selected for the first and second sleeves 16 and 20 are usually selected to allow the first sleeves 16 and 20 to be removed from their respective electroforming mandrels and to allow the first sleeve 20 of second elongated hollow member 24 to fit inside, contact and provide at least partial support for the first sleeve 16 of first elongated hollow member 12. Other shapes may be formed by using a fugitive layer on a mandrel core such as a Wood's metal coating on an electrically conductive or insulating master mandrel core.

Any suitable spacing may be utilized between contiguous portions of the outer surface of the first sleeve 20 of the second electroformed hollow member 24 and the inner surface of the first sleeve 16 of the first electroformed hollow member 12. The spacing selected depends upon the intended use of the composite metal article. The outer surface of the first sleeve 20 of the second elongated hollow member 24 may be slidable against the inner surface of the first sleeve 16 of the first elongated hollow member 12 or in rigid contact therewith. For example, a sliding relationship may be desirable for applications such as shock absorbers, pumps, telescopes, dash pots, viscometers and the like. For applications where an air, water, or other fluid tight fit is desired and two overlapping segments having a circular cross section are used, the difference in diameter length between the outer diameter of the first sleeve of the second elongated hollow member and the and the inner diameter of the inner surface of the first sleeve of the first elongated hollow member should be less than about 0.0001 inch (0.0025 mm).

When it is desirable to lock or swedge the two first sleeves against each other, the outside diameter of the inner sleeve may be provided with a gradual taper such that the perimeter of at least a portion of the outside surface of the inner first sleeve 20 is in intimate contact with the perimeter of at least a portion of the inner surface of the outer first sleeve 16 when the two sleeves are forced together. When the mating surfaces of the inner and outer sleeves are extremely smooth, good intimate contact and anchoring may be achieved with parallel surfaces free of any taper. If desired, the outer perimeter of the inside sleeve can be greater than the inside perimeter of the outer sleeve. For example, the inner sleeve may be compressed, sprung or otherwise distorted to permit insertion into the outer sleeve. Conversely, depending upon the cross sectional shapes of the inner and outer sleeves, the outer sleeve may be compressed, sprung or otherwise distorted to permit insertion of the inner sleeve. A locked relationship may be desirable for applications such as drive rollers, guide rollers, idler rollers, stationary guide bars, and the like. If desired, any suitable welding material or adhesive such as epoxy, acetate, urethane, and the like may be employed to adhere the first sleeves together.

Where the outer sleeve and the inner sleeve are to be locked together for applications where strength and rigidity along the length of first sleeves 16 and 20 of the elongated hollow article 10 is desirable, substantially total overlap of the first sleeve of the outer electroformed hollow member over the first sleeve of the second electroformed hollow member is desirable. Moreover, for maximum structural strength, substantially the entire outer surface of the inner first sleeve 20 should be in contact with substantially the entire inner surface of the outer first sleeve 16. Although the length of the first sleeve 16 of the first elongated electroformed hollow member 12 may have the same length of the first sleeve 20 of the second electroformed hollow member 24, one sleeve may have a different length than the other if desired. Similarly, the second sleeve of the first electroformed hollow member and the second sleeve of the second electroformed hollow member may be of any suitable length. The combination of a first elongated electroformed hollow member 12 having a circular cross section for the first sleeve 16 and a second electroformed elongated hollow member 24 having a circular cross section for the first sleeve 20 is preferred because of the ease of fabrication by electroforming and ease of subsequent assembly into a composite metal article.

Since the second sleeves 18 and 22 are at opposite ends of the composite electroformed hollow article 10 and therefore are not positioned within one another, it is unnecessary that the second sleeves 18 and 22 have identical or other cooperative cross-sectional shapes. Thus, either or both of the second sleeves 18 and 22 may be selected from any suitable shape. In FIG. 2, the second sleeve 22 of a second elongated hollow electroformed member 24 is illustrated as having a circular cross section. However, either or both of second sleeves 18 and 22 may have any other suitable configuration such as an oval, polygon (e.g. triangle, square, rectangle, hexagon, octagon, and the like), scalloped edge figure, toothed gear shaped pattern, screw thread configuration, babbit, horseshoe, egg, and the like. Moreover, the cross-sectional shape may be of any suitable regular or irregular shape. For example, in FIG. 3 a second sleeve 26 of a first elongated hollow electroformed member 28 is shown having a hexagonal cross section. In FIG. 4, a second sleeve 30 of a second elongated hollow electroformed member 32 is illustrated as having a square cross section. A second sleeve 34 of a first elongated hollow electroformed member 36 is shown having a generally circular cross section with a flattened side 38. Further, combinations of shapes such as cone and parallel side shape can be used for each second sleeve. 18 and 22. When using permanent reusable mandrels, it is important that the shapes of the second sleeves 18 and 22 are selected to allow the second sleeves 18 and 22 to be removed from their respective electroforming mandrels.

Referring to FIG. 6, a shaft 40 is illustrated comprising a plurality of hollow electroformed articles, 42, 44, and 46. Each electroformed article comprises two sleeves of different diameters adapted to either slip over or within a segment of an adjacent sleeve. Surprisingly, light weight composite articles having this configuration have exhibited excellent resistance to bending along the axis of the composite article.

In FIG. 7, a composite article is 50 shown comprising a first electroformed hollow article having a first sleeve 52 having a diameter smaller than the diameter of a second sleeve 54 and a second electroformed hollow article having a first sleeve 56 having a diameter smaller than the diameter of a second sleeve 58. The entire length of first sleeve 52 has been inserted within the hollow interior of first sleeve 56. However, only a segment of first sleeve 56 overlaps first sleeve 52. If desired, the article 50 may be modified so that only a segment of rather than the entire length of first sleeve 52 is overlapped by a segment of first sleeve 56.

The axis of rotation need not coincide with the geometric center of the composite metal article. In other words, at least one of the second sleeves, e.g. supporting shaft, may be positioned in a location that is different than along the center line of at least one of the electroformed elongated hollow members of the composite metal article. For example, the supporting shafts or second sleeves may be positioned in a location that is different from the center of a composite member having a circular cross section so that the member rotates with an eccentric motion.

If desired, as opening may be provided at the extreme ends of the second sleeve of each electroformed member to facilitate rapid removal of the electroformed member from the mandrel by allowing air to enter. The size of the opening is not particularly critical and can be formed by any suitable conventional technique such as masking.

Optionally, additional support may be supplied by inserting supplemental electroformed sleeves that are configured so that the outer surface of the inserted sleeve provides support for the overlying sleeve. These supplemental electroformed sleeves may comprise a second sleeve if the second sleeve does not interfere with assembly of the first and second electroformed elongated hollow members. Generally, the supplemental electroformed sleeve is inserted into the first sleeve of the second electroformed elongated hollow member prior to insertion of the first sleeve of the second electroformed elongated hollow Alternatively or in addition in the use of one or more supplemental inner sleeves, one or more outer sleeves may be utilized around the first sleeve of the larger electroformed elongated hollow member. The use of these supplemental sleeves is made possible because of the extremely precise control of sleeve dimensions achieved by electroforming techniques. The resulting laminated structure contributes to the overall bending resistance of the final article.

Generally, the electroformed hollow articles of this invention have relatively thin sleeves. For example, the sleeves may range in thickness from about 0.0005 inch (0.0125 mm) to about 0.020 inch (0.50 mm). Normally, thicker sleeve walls are desirable for electroformed hollow articles having relatively large perimeters of more than about 2 centimeters. However, some applications such heat exchange systems may dictate large perimeter articles having thin sleeve walls.

The first elongated electroformed hollow member may be formed of the same or different metal than the second electroformed hollow member. This may be desirable, for example, where the physical or chemical properties desirable for the outer sleeve differ from that of the inner sleeve. Thus, the inner and or outer sleeve may be made of very hard material such as nickel or nickel cobalt alloy for abrasive conditions or of nonreactive material such as gold or tin for corrosive chemical conditions, and the like. Moreover, the inner and or outer sleeve may be selected of materials that provide greater tensile or compressive strength to the composite metal article. Any suitable metal capable of being deposited by electroforming and having a coefficient of expansion of between about $6\times10^{-6}$ in/in/°F. and about $10\times10^{-6}$ in/in/°F. may be used in the process of this invention. Preferably, the electroformed metal has a ductility of at least about 8 percent elongation. Typical metals that may be electroformed include, nickel, copper, cobalt, iron, gold, silver, platinum, lead, and the like, and alloys thereof.

In view of the extremely accurate tolerances that may be achieved by electroforming the sleeves, excellent control of the relative movement and fit between the inner and outer sleeves may be achieved on a production line basis.

The core mandrels employed to form the elongated electroformed hollow member should normally be solid and of large mass or, in a less preferred embodiment, hollow with means to heat the interior to prevent cooling of the mandrel while the deposited coating is cooled. Thus, the mandrel has high heat capacity, preferably in the range from about 3 to about 4 times the specific heat of the electroformed article material. This determines the relative amount of heat energy contained in the electroformed article compared to that in the core mandrel. Further, the core mandrel should exhibit low thermal conductivity to maximize the difference in temperature (Delta T) between the electroformed article and the core mandrel during rapid cooling of the electroformed article to prevent any significant cooling and contraction of the core mandrel. In addition, a large difference in temperature between the temperature of the cooling bath and the temperature of the coating and mandrel maximizes the permanent deformation due to the stress-strain hysteresis effect. A high thermal coefficient of expansion is also desirable in a core mandrel to optimize permanent deformation due to the stress-strain hysteresis effect. Although an aluminum core mandrel is characterized by a high thermal coefficient of expansion, it exhibits high thermal conductivity and low heat capacity which are less effective for optimum permanent deformation due to the stress-stain hysteresis effect. Typical mandrels include stainless steel, iron plated with chromium or nickel, nickel, titanium, aluminum plated with chromium or nickel, titanium palladium alloys, inconel 600, Invar and the like. The outer surface of the mandrel should be passive, i.e. abhesive, relative to the metal that is electrodeposited to prevent adhesion during electroforming. The cross-sectional configuration of the mandrels may be of any suitable shape so long as they have at least two different outside perimeters which correspond to the first and second sleeves of the first and second electroformed elongated hollow members. Typical shapes include circles, ovals, regular and irregular polygons such as triangles, squares, hexagons, octagons, rectangles and the like. For mandrels having a convex polygon cross-sectional shape, the distance across adjacent peaks of the cross-sectional shape is preferably at least twice the depth of the valley between the peaks (depth of the valley being the shortest distance from an imaginary line connecting the peaks to the bottom of the valley) to facilitate removal of the electroformed articles from the mandrels without damaging the articles and to ensure uniform wall thickness. The surfaces of the mandrels usually substantially parallel to the axis of each mandrel to permit removal of the electroformed article from the mandrel, or if tapered, the taper should be toward the end of the mandrel from which the electroformed member is removed. For articles having a segmental cross-sectional area of less than about 1.8 $in^2$ (11.25 $cm^2$), the mandrel should have an overall length to segmental cross-sectional area ratio greater than about 0.6. Thus, a mandrel having a segmental cross-sectional area of about 1.8 $in^2$ (11.25 $cm^2$) would have a length of at least about 1 inch (2.5 cm). Excellent results have been obtained with the process of this invention with a pair of solid cylindrical core mandrels; one mandrel having a segmental cross-sectional area of about 0.6866 $in^2$ (4.428 $cm^2$) or 0.9350 in diameter (2.375 cm) and a length of about 24 inches (61 cm) corresponding to the first sleeve of the first elongated electroformed hollow member and a segmental cross-sectional area of about 0.074 $in^2$ (0.45 $cm^2$) or 0.303 in in diameter (0.7575 cm) and a length of about 1.25 in (2.858 cm) corresponding to the second sleeve of the first elongated electroformed hollow member; and the other mandrel having a segmental cross-sectional area of about 0.6686 $in^2$ (4.167 $cm^2$) or 0.923 in diameter (2.344 cm) and a length of about 24 in (61 cm) corresponding to the first sleeve of the second elongated electroformed hollow member and a segmental cross-sectional area of about 0.0721 $in^2$ (0.45 $cm^2$) or 0.303 in. diameter 0.757 cm) and a length of about 1.125 in (2.858 cm) corresponding to the second sleeve of the second elongated electroformed hollow member.

An adequate parting gap may be obtained even for electroformed articles having a small diameter or small cross-sectional area by controlling the stress-strain hysteresis characteristics of the electroformed article. For example, sufficient hysteresis along may be utilized to achieve an adequate parting gap to remove an electroformed article from a mandrel having a diameter of about 1.5 inches in the absence of any assistance from internal stress characteristics of the electroformed article or from any difference in thermal coefficients of expansion of the electroformed article and mandrel. The internal stress of an electroformed article includes tensial stress and the compressive stress. In tensial stress, the material has a propensity to become smaller than its current size. This is believed to be due to the existence of many voids in the metal lattice of the electroformed deposit with a tendency of the deposited material to contract to fill the voids. However, if there are many extra atoms in the metal lattice instead of voids, such as metal atoms or foreign materials, there is a tendency for the electroformed material to expand and occupy a larger space.

Stress-strain hysteresis is defined as the stretched (deformed) length of a material in inches minus the original length in inches divided by the original length in inches. The stress-strain hysteresis characteristics of the electroformed articles having a small diameter or small cross-sectional area should be maximized about 0.00015 in/in.

The hysteresis characteristics of a given electroformed material may be controlled by adjusting the electroforming process conditions and the composition of the electroforming bath. Control involves adjusting the pH, metal component concentration, bath temperature, speed of core mandrel rotation, and the like. With each adjustment, a hysteresis stress strain curve is plotted for the product prepared with a given bath composition and the electroforming process conditions. Alterations are then again made to the electroforming process conditions and/or the composition of the electroforming bath until the hysteresis of the stress-strain curve is maximized.

When electroforming nickel articles having a small diameter or small cross-sectional area, the pH of the bath should be between about 3.75 and about 3.95 with optimum hysteresis characteristics being achieved at a pH of about 3.85. The relationship of nickel bath pH control to hysteresis may be determined, for example, by cutting rectangular samples from electroformed nickel articles prepared on 1 inch diameter stainless steel (304) mandrels having a length of about 24 inches in different electroforming baths maintained at 140° F. and nickel concentration of 11.5 oz/gal but held at different pH values and plotting these data against the pH value of the bath in which each electroformed nickel article was made. A parting temperature of about 40° F. was employed. In order to remove an electroformed article from a core mandrel having a segmental cross-sectional area of less than about 1.8 square inches and an overall length to segmental cross-sectional area ratio greater than about 0.6, the stress-strain hysteresis must be at least about 0.00015 in/in. between about 135° F. and about 145° F. with optimum hysteresis being achieved at a bath temperature of about 140° F. In order to remove an electroformed article from a core mandrel having a segmental cross-sectional area of less than about 1.8 square inches and an overall length to segmental cross-sectional area ratio greater than about 0.6, the stress-strain hysteresis must be at least about 0.00015 in/in.

A preferred concentration of nickel for electroforming nickel articles having a segmental cross-sectional area of less than about 1.8 square inches and an overall length to segmental cross-sectional area ratio greater than about 0.6, should be between about 11 oz/gal and about 12 oz/gal with optimum being about 11.5. oz/gal.

When the boric acid concentration drops below about 4 oz/gal, bath control diminishes and surface flaws increase. The boric acid concentration is preferably maintained at about the saturation point at 100° F. Optimum hysteresis may be achieved with a boric acid concentration of about 5 oz. per gallon. When the boric acid concentration exceeds about 5.4 oz/gal, precipitation can occur in localized cold spots thereby interfering with the electroforming process.

To minimize surface flaws such as pitting, the surface tension of the plating solution is adjusted to between about 33 dynes per square centimeter to about 37 dynes per square centimeter. The surface tension of the solution may be maintained within this range by adding an anionic surfactant such as sodium lauryl sulfate, sodium alcohol sulfate (Duponol 80, available from E. I. duPont de Nemours and Co., Inc.), sodium hydrocarbon sulfonate (Petrowet R, available from E. I duPont de Nemours and Co., Inc.) and the like. Up to about 0.014 oz/gal of an anionic surfactant may be added to the electroforming solution. The surface tension in dynes per centimeter is generally about the same as that described in U.S. Pat. No. 3,844,906. The concentration of sodium lauryl sulfate is sufficient to maintain the surface tension at about 33 dynes per centimeter to about 37 dynes per centimeter.

A preferred current density is between about 300 amps per square foot and about 400 amps per square foot. Higher current densities may be achieved by increasing the electrolyte flow, mandrel rotational speed, electrolyte agitation, and cooling. Current densities as high as 900 amps per square foot have been demonstrated.

Parting conditions are also optimized by cooling the outer surface of the electroformed article rapidly to cool the entire deposited coating prior to any significant cooling and contracting of the core mandrel permanently deform the electroformed article. The rate of cooling should be sufficient to impart a stress in the electroformed article of between about 40,000 psi and about 80,000 psi to permanently deform the electroformed article and to render the length of the inner perimeter of the electroformed article incapable of contracting to less than 0.04 percent greater than the length of the outer perimeter of the core mandrel after the core mandrel is cooled.

The difference in temperature between the coating and the outer cooling medium must be sufficiently less than the difference in temperature between the cooling medium and the temperature of the core mandrel during the stretching phase of the process to achieve sufficient permanent deformation of the electroformed article. Nickel has a low specific heat capacity and a high thermal conductivity. Thus, when an assembly of an electroformed cylindrical nickel article on a solid stainless steel core mandrel, such as 304 stainless steel, having a diameter of about 1 inch originally at a temperature of 140° F. is cooled by immersion in a liquid bath at a temperature of about 40° F., the temperature of the electroformed article may be dropped to 40° F. in less than 1 second whereas the mandrel itself requires 10 seconds to reach 40° F. after immersion. However, because of the rapid rate of cooling and contraction of thin walled core mandrels, an electroformed article cannot be removed from the mandrel by utilizing a cooling medium surrounding the outer surface of the electroformed article where the mandrel has a segmental cross-sectional area of less than about 1.8 square inches and an overall length to segmental cross-sectional area ratio greater than about 0.6.

The electroforming process for forming the composite article of this invention may be conducted in any suitable electroforming device. For example, a solid cylindrically shaped mandrel may be suspended vertically in an electroplating tank. The mandrel is constructed of electrically conductive material that is compatible with the metal plating solution. For example, the mandrel may be made of stainless steel. The top edge of the mandrel may be masked off with a suitable nonconductive material, such as wax to prevent deposition.

The mandrel may be of any suitable cross section including circular, rectangular, triangular and the like. The electroplating tank is filled with a plating solution and the temperature of the plating solution is maintained at the desired temperature. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank and immersed in a cold water bath. The temperature of the cold water bath should be between about 80° F. and about 33° F. When the mandrel is immersed in the cold water bath, the deposited metal is cooled prior to any significant cooling and contracting of the solid mandrel to impart an internal stress of between about 40,000 psi and about 80,000 psi to the deposited metal. Since the metal cannot contract and is selected to have a stress-strain hysteresis of at least about 0.00015 in/in, it is permanently deformed so that after the core mandrel is cooled and contracted, the deposited metal article may be removed from the mandrel. The deposited metal article does not adhere to the mandrel since the mandrel is selected from a passive material. Consequently, as the mandrel shrinks after permanent deformation of the deposited metal, the deposited metal article may be readily slipped off the mandrel.

A suitable electroforming apparatus for carrying out the process described above except for use of a solid mandrel is described, for example, in British Pat. No. 1,288,717, published Sept. 13, 1972. The entire disclosure of this British Patent Specification is incorporated herein by reference.

A typical electrolytic cell for depositing metals such as nickel may comprise a tank containing a rotary drive means including a mandrel supporting drive hub centrally mounted thereon. The drive means may also provide a low resistance conductive element for conducting a relatively high amperage electrical current between the mandrel and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode comprises sulfur depolarized nickel. Suitable sulfur depolarized nickel is available under the tradenames, "SD" Electrolytic Nickel and "S" Nickel Rounds from International Nickel Co. Nonsulfur depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

Electroforming may be carried out in a nickel sulfamate solution treating loop. For example, an article can be electroformed by preheating a solid electrically conductive mandrel at a preheating station. Preheating can be effected by contacting the mandrel with a nickel sulfamate solution at about 140° F. (60° C.) for a sufficient period of time to bring the solid mandrel to about 140° F. (60° C.). Preheating in this manner allows the mandrel to expand to the dimensions desired in the electroforming zone and enables the electroforming operation to begin as soon as the mandrel is placed in the electroforming zone. Thereafter, the mandrel is transported from the preheating station to an electroforming zone. The electroforming zone may comprise at least one cell containing an upstanding electrically conductive rotatable spindle which is centrally located within the cell and a concentrically located container spaced therefrom which contains donor metallic nickel. The cell is filled with nickel sulfamate electroforming solution. The mandrel is positioned on the upstanding electrically conductive rotatable spindle and is rotated thereon. A DC potential is applied between the rotating mandrel cathode and the donor metallic nickel anode for a sufficient period of time to effect electrodeposition of nickel on the mandrel to a predetermined thickness of at least 30 Angstroms. Upon completion of the electroforming process, the mandrel and the nickel article formed thereon are transferred to a nickel sulfamate solution recovery zone. Within this zone, a major portion of the electroforming solution dragged out of the electroforming cell is recovered from the belt and mandrel. Thereafter, the electroformed article-bearing mandrel is transferred to a cooling zone containing water maintained at about 40° F. (4.4° C.) to 80° F. (26.7° C.) or cooler for cooling the mandrel and the electroformed article whereby the electroformed article is cooled prior to any significant cooling and contracting of the mandrel whereby a stress of between about 40,000 psi and about 80,000 psi is imparted to the cooled electroformed article to permanently deform the electroformed article and to render the length of the inner perimeter of the electroformed article incapable of contracting to less than about 0.4 percent greater than the length of the outer perimeter of the core mandrel after the core mandrel is cooled and contracted. Cooling is then continued to cool and contract the solid mandrel. After cooling, the mandrel and electroformed article are passed to a parting and cleaning station at which the electroformed article is removed from the mandrel, sprayed with water and subsequently passed to a dryer. The mandrel is sprayed with water and checked for cleanliness before being recycled to the preheat station to commence another electroforming cycle. Electroformed article having a segmental cross sectional area of less than about 1.8 $in^2$ must have a stress-strain hysteresis of at least about 0.00015 in/in. Moreover, the electroformed article must have an internal stress of between about 1,000 psi and about 15,000 compressive, i.e.

| |
|---|
| +1,000<br>0 psi,<br>−15,000 |

to permit rapid parting of the electroformed article from the mandrel. The electroformed article must have a thickness of at least about 30 Angstroms in order to allow sufficient permanent deformation utilizing the stress-strain hysteresis characteristics of the electroformed article.

Very high current densities are employed with a nickel sulfamate electroforming solution. Generally, the current densities range from about 150 amps per square foot to about 500 amps per square foot, with a preferred current density of about 300 amps per square foot. Current concentrations generally range from about 5 to about 20 amps per gallon.

At the high current density and high current concentration, a great deal of heat is generated in the metal or metal alloy electroforming solution within the electroforming cell for small sectional area hollow articles. This heat must be removed in order to maintain the solution temperature within the cell in the range of about 135° F. to about 145° F., and preferably at about 140° F. At temperatures below about 135° F., there is a sufficient decrease in the desired stress strain hysteresis needed for removal of the electroformed nickel article from the mandrel without damaging the mandrel or the article. At temperatures of above about 160° F., hydrolysis of the nickel sulfamate occurs under the acid conditions maintained in the solution resulting in the generation of $NH4^+$ which is detrimental to the process as it increases tensile stress and reduces ductility in the nickel belt.

Because of the significant effects of both temperature and solution composition on the final small cross-sectional area product as discussed herein, it is necessary to maintain the electroforming solution in a constant state of agitation thereby substantially precluding localized hot or cold spots, stratification and inhomogeneity in the composition. Moreover, constant agitation continuously exposes the mandrel to fresh solution and, in so doing, reduces the thickness of the cathode film thus increasing the rate of diffusion through the film and thus enhancing nickel deposition. Agitation is maintained by continuous rotation of the mandrel and by impingement of the solution of the mandrel and cell walls as the solution is circulated through the system. Generally, the solution flow rate across the mandrrel surface can range from about 4 linear feet per second to about 10 linear feet per second. For example, at a current density of about 300 amps per square foot with a desired solution temperature range within the cell of about 138° F. (58.9° C.) to about 142° F. (61.1° C.), a flow rate of about 20 gal/min of solution has been found sufficient to effect proper temperature control. The combined effect of mandrel rotation and solution impingement assures uniformity of composition and temperature of the electroforming solution within the electroforming cell.

For continuous, stable operation to achieve a stress-strain hysteresis of at least about 0.00015 in/in, the composition of the aqueous nickel sulfamate solution within the electroforming zone should be as follows:

Total nickel: 11 to 12 oz/gal
$H_3BO_3$: 4 to 5 oz/gal
pH: 3.80 to 3.90
Surface Tension: 33 to 37 dynes/cm2

A metal halide, generally a nickel halide such as nickel chloride, nickel bromide, or nickel fluoride and preferably, nickel chloride, are included in the nickel sulfamate electroforming solution to avoid anode polarization. Anode polarization is evidenced by gradually increasing pH.

The pH of the nickel electroforming solution should be between about 3.8 and about 3.9. At a pH of greater than about 4.1 surface flaws such as gas pitting increase. Also, internal stress increases and interferes with parting of the electroformed belt from the mandrel. At a pH of less than about 3.5, the metallic surface of the mandrel can become activated, especially when a chromium plated mandrel is employed, thereby causing the metal electroformed to adhere to the chromium plating. Low pH also results in lower tensile strength. The pH level may be maintained by the addition of an acid such as sulfamic acid, when necessary. Control of the pH range may also be assisted by the addition of a buffering agent such as boric acid within a range of about 4 oz/gal to about 5 oz/gal.

In order to maintain a continuous steady state operation, the nickel sulfamate electroforming solution can be continuously circulated through a closed solution treating loop. This loop may comprise a series of processing stations which maintain a steady state composition of the solution, regulate the temperature of the solution and remove any impurities therefrom.

The electroforming cell may contain, for example, one wall thereof which is shorter than the others and acts as a weir over which the electroforming solution continuously overflows to a trough as recirculating solution is continuously pumped into the cell via a solution distributor manifold or sparger along the bottom of the cell. The solution flows from the electroforming cell via the trough to an electropurification zone and a solution sump. The solution is then pumped to a filtration zone and to a heat exchange station and is then recycled in purified condition at a desired temperature and composition to the electroplating cell whereupon that mixture with the solution contained therein in a steady state condition set forth above are maintained on a continuous and stable basis.

The electrolytic zone removes the dissolved nobel metallic impurities from the nickel sulfamate solution prior to filtering. A metal plate of steel, or preferably stainless steel, can be mounted in the electrolytic zone to function as the cathode electrode. Anodes can be provided by a plurality of anode baskets which comprise tubular shaped metallic bodies, preferably titanium, each having a fabric anode bag. A DC potential can applied between the cathodes and the anodes of the purification station from a DC source. The electropurification zone can include a wall which extends coextensively with the wall of the solution sump zone and functions as a weir.

The solution can be replenished by the automatic addition of deionized water from a suitable source and/or by recycling solution from a nickel rinse zone. A pH meter can be employed for sensing the pH of the solution and for effecting the addition of an acid such as sulfamic acid when necessary to maintain essentially constant pH. The stress reducing agents and surfactant can be continuously added by suitable pumps.

The electroforming solution which flows from the electroforming cell is raised in temperature due to the flow of relatively large currents therein and accompanying generation of heat in the electroforming cell. Means may be provided at a heat exchanging station for cooling the electroforming solution to a lower temperature. The heat exchanger may be of any conventional design which receives a coolant such as chilled water from a cooling or refrigerating system. The electroplating solution which is cooled in the heat exchanger means can be successively pumped to a second heat exchanger which can increase the temperature of the cool solution to within relatively close limits of the desired temperature. The second heat exchanger can be heated, for example, by steam derived from a steam generator. The first cooling heat exchanger can, for example, cool the relatively warm solution from a temperature of about 145° F. (62.8° C.) or above to a temperature of about 135° F. (57.2° C.). A second warming heat exchange can heat the solution to a temperature of 140° F. (60° C.). The efflux from the heat exchange station can then be pumped to the electroforming cell.

By manipulating the bath parameters such as the addition of enhancers, altering pH, changing the temperatures, adjusting the cation concentration of the electroforming bath, regulating current density, one may alter the stress-strain hysteresis of the electroformed article. Thus the conditions are experimentally altered until a deposited electroformed article is characterized by a stress-strain hysteresis of at least about 0.00015 in/in. For example, when electroforming nickel, the relative quantity of enhancers such as saccharine, methylbenzene sulfonamide, the pH, the bath temperature, the nickel cation concentration, and the current density may be adjusted to achieve a stress-strain hysteresis of at least about 0.00015 in/in. Current density affects the pH and the nickel concentration. Thus, if the current density increases, the nickel is unable to reach the surface of the core mandrel at a sufficient rate and the ½ cell voltage increases and hydrogen ions deposit thereby increasing the hydroxyl ions remaining in the bath thereby increasing the pH. Moreover, increasing the current density also increases the bath temperature.

In order to achieve a sufficient parting gap with hollow electroformed articles having a segmental cross-sectional area less than about 1.8 square inches and an overall length to segmental cross-sectional area ratio greater than about 0.6, the electroformed coating should have a thickness of at least about 30 Angstroms and a stress strain hysteresis of at least about 0.00015 in/in. Moreover, the exposed surface of the electroformed article on the mandrel must be rapidly cooled prior to any significant cooling and contracting of the core mandrel.

DESCRIPTION OF PREFERRED EMBODIMENTS

Figure 1:
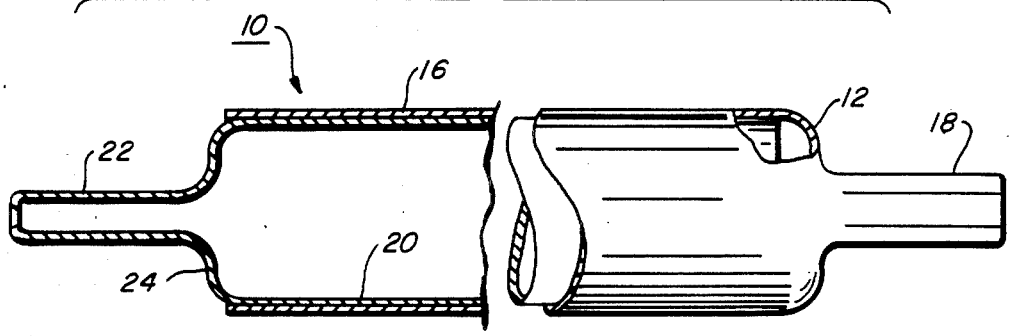
Figure 2:
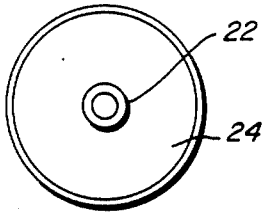
Figure 3:
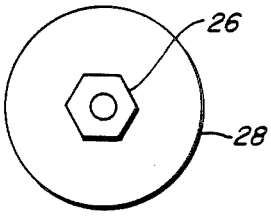
Figure 4:
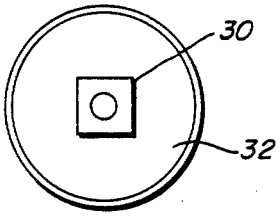
Figure 5:
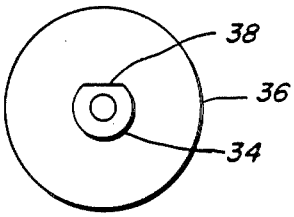
Figure 6:
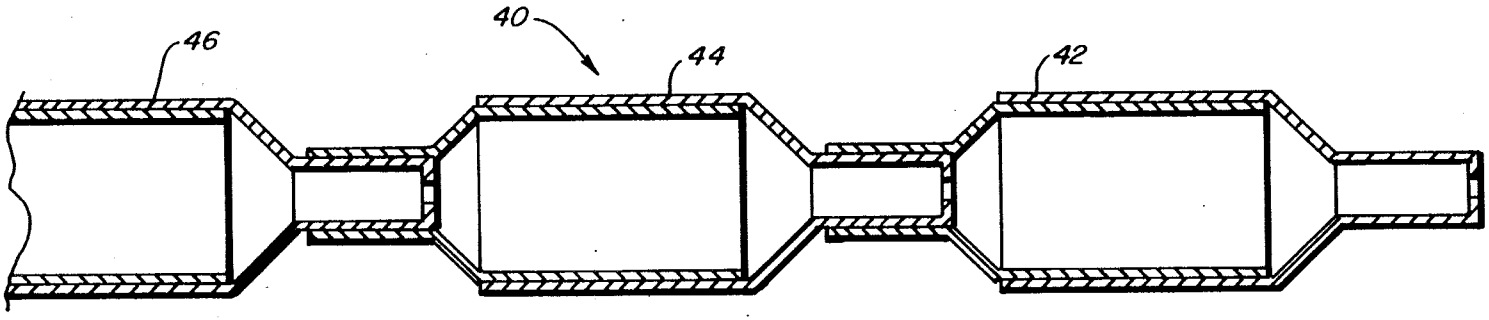
Figure 7:
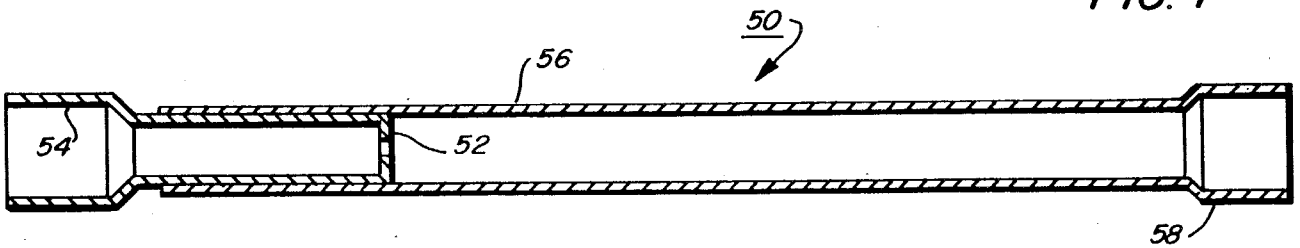

The following examples further define, describe and compare exemplary methods of preparing the electroformed articles of the present invention. Parts and percentages are by weight unless otherwise indicated. The examples are also intended to illustrate the various preferred embodiments of the present invention. Unless indicated otherwise, all mandrels are cylindrically shaped with sides parallel to the axis.

EXAMPLES I–IV

Except as noted in the Examples, the general process conditions for the following first four Examples were constant and are set forth below:

Current Density: 285 amps/ft$^2$ (28.5 amp/dm$^2$)
Agitation Rate (linear solution flow over the cathode surface): 1–5 ft/sec (30–152 cm/sec)
pH: 3.8–3.9
Surface Tension: 33–39 dynes/cm
$H_3BO_3$: 4–5 oz/gal
Sodium Lauryl Sulfate: 0.0007 oz/gal (0.0052 g/L)

EXAMPLE I

A composite hollow metal article comprising two overlapping elongated electroformed hollow members was prepared with the aid of two elongated cylindrical mandrels designated in the Tables below as a first mandrel and a second mandrel. Each mandrel had a supported end and a free end and a circumferential, cylindrical electroforming first segment surface extending from about the supported end to a short distance from the free end. Between the extreme end of the free end of the mandrel and the first segment surface was a circumferential cylindrical electroforming second segment surface having a smaller perimeter than the first segment surface. The perimeter of the first segment electroforming surface of the second elongated electroforming mandrel was selected to be sufficiently smaller than the perimeter of the first segment electroforming surface of the first elongated electroforming mandrel so that the hollow metal article sleeve electroformed on the first segment electroforming surface of the second elongated electroforming mandrel readily slid into the hollow interior of the hollow metal sleeve electroformed on the first segment electroforming surface of the first elongated electroforming mandrel. The dimensions of these mandrels are also set forth in the tables below. Each of these mandrels were immersed vertically with the free end facing downwardly in electroplating baths.

FIRST MANDREL

Mandrel Core material: stainless steel (304)
Mandrel Perimeter of 1st segment (inches): 2.937
Mandrel cross sectional shape of 1st segment: Round
Mandrel Perimeter of 2nd segment (inches): 0.9519
Mandrel cross sectional shape of 2nd segment: Round
Mandrel Length 1st segment (inches): 24
Mandrel Length 2nd segment (inches): 1.125
Ni (oz/gal): 11.5
$NiCl_2.6H_2O$ (oz/gal): 6
Anode: electrolytic Ni
Plating Temp. (°F.) $T_2$: 140
Delta T ($T_2$-$T_1$) (°F.): 100
Parting Gap (in.) for 1st segment at: 0.00014
$T_1$ (Parting Temp. °F.): 40
Parting Gap (in) for 2nd segment at: 0.000075
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

SECOND MANDREL

Mandrel Core material: stainless steel (304)
Mandrel Perimeter of 1st segment (inches): 2.8996
Mandrel cross sectional shape of 1st segment: Round
Mandrel Perimeter of 2nd segment (inches): 0.9519
Mandrel cross sectional shape of 2nd segment: Round
Mandrel Length 1st segment (inches): 24
Mandrel Length 2nd segment (inches): 1.25
Ni (oz/gal): 11.5
$NiCl_2.6H_2O$ (oz/gal): 6
Anode: electrolytic Ni
Plating Temp. (°F.) $T_2$: 140
Delta T ($T_2$-$T_1$) (°F.): 100
Parting Gap (in) for 1st segment at: 0.000138
$T_1$ (Parting Temp. °F.): 40
Parting Gap (in.) for 2nd segment at: 0.0000454
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

The first sleeve of the hollow electroformed article from the second elongated mandrel was inserted by hand inside the first sleeve of the hollow article from the first elongated mandrel so that the outer surface of the first sleeve of the hollow article from the second elongated mandrel was substantially contiguous with the inner surface of the first sleeve of the hollow article from the first elongated mandrel. The resulting composite metal article could not be pulled apart by hand. The second sleeve of each hollow article protruding from opposite ends of the composite metal article were inserted into complementary ball bearing support bearings which allowed the composite metal article to be used as a freely rotating roller

EXAMPLE II

A composite hollow metal article comprising two overlapping elongated electroformed hollow members was prepared with the aid of two elongated cylindrical mandrels designated in the Tables below as a first mandrel and a second mandrel. Each mandrel had a supported end and a free end and a circumferential, cylindrical electroforming first segment surface extending from about the supported end to a short distance from the free end. Between the extreme end of the free end of the first mandrel and the first segment surface of the first mandrel was a circumferential cylindrical electroforming second segment surface having a smaller perimeter than the first segment surface and between the extreme end of the free end of the second mandrel and the first segment surface of the second mandrel was a circumferential hexagonal electroforming second segment surface having a smaller perimeter than the first segment surface. The perimeter of the first segment electroforming surface of the second elongated electroforming mandrel was selected to be sufficiently smaller than the perimeter of the first segment electroforming surface of the first elongated electroforming mandrel so that the hollow metal article sleeve electroformed on the first segment electroforming surface of the second elongated electroforming mandrel readily slid into the hollow interior of the hollow metal sleeve electroformed on the first segment electroforming surface of the first elongated electroforming mandrel. The dimensions of these mandrels are also set forth in the tables below. Each of these mandrels was immersed vertically with the free end facing downwardly in electroplating baths.

FIRST MANDREL

Mandrel Core material: stainless steel (304)
Mandrel Perimeter of 1st segment (inches): 1.9034
Mandrel cross sectional shape of 1st segment: Round
Mandrel Perimeter of 2nd segment (inches): 0.9139
Mandrel cross sectional shape of 2nd segment: Round
Mandrel Length 1st segment (inches): 48
Mandrel Length 2nd segment (inches): 1.681
Ni (oz/gal): 11.5
$NiCl_2.6H_2O$ (oz/gal): 6
Anode: electrolytic Ni
Plating Temp. (°F.) $T_2$: 140
Delta T($T_2$–$T_1$) (°F.): 100
Parting Gap (in.) for 1st segment at: 0.000091
$T_1$ (Parting Temp. °F.): 40
Parting Gap (in) for 2nd segment at: 0.000044
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

SECOND MANDREL

Mandrel Core material: stainless steel (304)
Mandrel Perimeter of 1st segment (inches): 1.8280
Mandrel cross sectional shape of 1st segment: Round
Mandrel Perimeter of 2nd segment (inches): 0.6
Mandrel cross sectional shape of 2nd segment: Hexigon
Mandrel Length 1st segment (inches): 48
Mandrel Length 2nd segment (inches): 1.681
Ni (oz/gal): 11.5
$NiCl_2.6H_2O$ (oz/gal): 6
Anode: electrolytic Ni
Plating Temp. (°F.) $T_2$: 140
Delta T ($T_2$–$T_1$) (°F.): 100
Parting Gap (in.) for 1st segment at: 0.000087
$T_1$ (Parting Temp. °F.): 40
Parting Gap (in) for 2nd segment at: 0.000024
T1 (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

The first sleeve of the hollow electroformed article from the second elongated mandrel was inserted by hand inside the first sleeve of the hollow article from the first elongated mandrel so that the outer surface of the first sleeve of the hollow article from the second elongated mandrel was substantially contiguous with the inner surface of the first sleeve of the hollow article from the first elongated mandrel. The resulting composite metal article could not be pulled apart by hand. The second cylindrical sleeve protruding from one end of the composite metal article was inserted into a complementary nylon support bearing and the other hexagonal sleeve protruding from the opposite end of the composite metal article roller was inserted into a hole having a complementary hexagonal shape in a plastic universal joint which in turn was driven by an electric motor. In operation, the motor rotated the composite roller by rotating the plastic universal joint.

EXAMPLE III

A composite hollow metal article comprising two overlapping elongated electroformed hollow members was prepared with the aid of two elongated cylindrical mandrels designated in the Tables below as a first mandrel and a second mandrel. Each mandrel had a supported end and a free end and a circumferential, cylindrical electroforming first segment surface extending from about the supported end to a short distance from the free end. Between the extreme end of the free end of the mandrel and the first segment surface on the first electroforming mandrel was a circumferential cylindrical electroforming second segment surface having a smaller perimeter than the first segment surface. Between the extreme end of the free end of the mandrel and the first segment surface on the second electroforming mandrel was a circumferential cylinder electroforming second segment surface having a smaller perimeter than the first segment surface. The perimeter of the first segment electroforming surface of the second elongated electroforming mandrel was selected to be sufficiently smaller than the perimeter of the first segment electroforming surface of the first elongated electroforming mandrel so that the hollow metal article sleeve electroformed on the first segment electroforming surface of the second elongated electroforming mandrel readily slid into the hollow interior of the hollow metal sleeve electroformed on the first segment electroforming surface of the first elongated electroforming mandrel. The dimensions of these mandrels are also set forth in the tables below. Each of these mandrels were immersed vertically with the free end facing downwardly in electroplating baths.

FIRST MANDREL

Mandrel Core material: stainless steel (304)
Mandrel Perimeter of 1st segment (inches): 3.1038
Mandrel cross sectional shape of 1st segment: Round
Mandrel Perimeter of 2nd segment (inches): 1.9226
Mandrel cross sectional shape of 2nd segment: Round
Mandrel Length 1st segment (inches): 8
Mandrel Length 2nd segment (inches): 16
Ni (oz/gal): 11.5
$NiCl_2.6H_2O$ (oz/gal): 6
Anode: electrolytic Ni
Plating Temp. (°F.) $T_2$: 140
Delta T ($T_2$–$T_1$) (°F.): 100
Parting Gap (in) for 1st segment at: 0.000148
$T_1$ (Parting Temp. °F.): 40
Parting Gap (in) for 2nd segment at: 0.000092
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

SECOND MANDREL

Mandrel Core material: stainless steel (304)
Mandrel Perimeter of 1st segment (inches): 3.1038
Mandrel cross sectional shape of 1st segment: Round
Mandrel Perimeter of 2nd segment (inches): 1.8849
Mandrel cross sectional shape of 2nd segment: Round
Mandrel Length 1st segment (inches): 8
Mandrel Length 2nd segment (inches): 16
Ni (oz/gal): 11.5
$NiCl_2.6H_2O$ (oz/gal): 6
Anode: electrolytic Ni
Plating Temp. (°F.) $T_2$: 140
Delta T ($T_2$–$T_1$) (°F.): 100
Parting Gap (in) for 1st segment at: 0.000148
$T_1$ (Parting Temp. °F.): 40
Parting Gap (in.) for 2nd segment at: 0.00009
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

The second sleeve of the hollow electroformed article from the second elongated mandrel was inserted by hand inside the second sleeve of the hollow article from the first elongated mandrel so that the outer surface of the second sleeve of the hollow article from the second elongated mandrel was substantially contiguous with the inner surface of the second sleeve of the hollow article from the first elongated mandrel. The resulting composite metal article could not be pulled apart by hand. Ball bearings were press fit into the first sleeves of each hollow article protruding from each end of the composite metal article.

EXAMPLE IV

A composite hollow metal article comprising two overlapping elongated electroformed hollow members was prepared with the aid of two elongated mandrels designated having a cylindrical shape and referred to in the Tables below as a first mandrel and a second mandrel. Each mandrel had a supported end and a free end and a circumferential, cylindrical electroforming first segment surface extending from about the supported end a short distance from the supported end. The first elongated electroforming mandrelhad four segments which were all chlindrical. The second elongated electroforming mandrel had three segments, the first and third segments were cylindrical but the second segment was cylindrical with a a flat side such that it could be used as a "D" ring. The perimeter of the first segment electroforming surface of the second elongated electroforming mandrel was selected to be sufficiently smaller than the perimeter of the second segment electroforming surface of the first elongated electroforming mandrel so that the hollow metal article sleeve electroformed on the first segment electroforming surface of the second elongated electroforming mandrel readily slid into the hollow interior of the hollow metal sleeve electroformed on the second segment electroforming surface of the first elongated electroforming mandrel. The dimensions of these mandrels are also set forth in the tables below. Each of these mandrels were immersed vertically with the free end facing downwardly in electroplating baths.

FIRST MANDREL

Mandrel Core material: stainless steel (304)
Mandrel Perimeter of 1st segment (inches): 18.849

Mandrel cross sectional shape of 1st segment: Round
Mandrel Perimeter of 2nd segment (inches): 3.1792
Mandrel cross sectional shape of 2nd segment: Round
Mandrel Perimeter of 3rd segment (inches): 2.5132
Mandrel cross sectional shape of 3rd segment: Round
Mandrel Perimeter of 4th segment (inches): 0.9425
Mandrel cross sectional shape of 4th segment: Round
Mandrel Length 1st segment (inches): 1
Mandrel Length 2nd segment (inches): 4
Mandrel Length 3rd segment (inches): 16
Mandrel Length 4th segment (inches) 2
Ni (oz/gal): 11.5
$NiCl_2.6H_2O$ (oz/gal): 6
Anode: electrolytic Ni
Plating Temp. (°F.) $T_2$: 140
Delta T ($T_2$–$T_1$) (°F.): 100
Parting Gap (in) for 1st segment at $T_1$: 0.0009
Parting Gap (in.) for 2nd segment at $T_1$: 0.000152
Parting Gap (in.) for 3rd segment at $T_1$: 0.00012
Parting Gap (in.) for 4th segment at $T_1$: 0.000045
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

SECOND MANDREL

Mandrel Core material: stainless steel (304)
Mandrel Perimeter of 1st segment (inches): 3.14515
Mandrel cross sectional shape of 1st segment: Round
Mandrel Perimeter of 2nd segment (inches): 2.9641
Mandrel cross sectional shape of 2nd segment: "D"
Mandrel Perimeter of 3rd segment (inches): 0.9425
Mandrel cross sectional shape of 3rd segment: Round
Mandrel Length 1st segment (inches): 5
Mandrel Length 2nd segment (inches): 1.5
Mandrel Length rdd segment (inches): 2
Ni (oz/gal): 11.5
$NiCl_2.6H_2O$ (oz/gal): 6
Anode: electrolytic
Plating Temp. (°F.) $T_2$: 140
Delta T ($T_2$–$T_1$): 100
Parting Gap (in.) for 1st segment at: 0.00015
Parting Gap (in.) for 2nd segment at $T_1$: 0.0
Parting Gap (in.) for 3rd segment at $T_1$: 0.000045
$T_1$ (Parting Temp. °F.): 40
Saccharin Concentration: 0
2-MBSA/Saccharine: 0
Mole Ratio-Saccharine/Ni: 0
Surface Roughness (micro inches, RMS): 4
Internal Stress, psi: −3,000
Tensile Strength, psi: 93,000
Elongation (percent in 2 in): 12

The first sleeve of the hollow electroformed article from the second elongated mandrel was inserted by hand inside the first and second sleeves of the hollow article from the first elongated mandrel so that the outer surface of the first sleeve of the hollow article from the second elongated mandrel was substantially contiguous with the inner surface of the second sleeve of the hollow article from the first elongated mandrel. The resulting composite metal article could not be pulled apart by hand. The fourth sleeve from the first mandrel and the third sleeve from the second mandrel of each hollow article protruding from opposite ends of the composite metal article were inserted into a support bearing which had a complementary shaped hole. A drive mechanism was coupled to the "D" shaped second sleeve of the hollow article from the second elongated mandrel.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. A composite metal article comprising a first elongated electroformed hollow member and a second electroformed elongated hollow member, each of said hollow members comprising at least a first sleeve and a second sleeve, one sleeve of each of said hollow members having a perimeter smaller than the perimeter of the other sleeve of the same member, at least a segment of the outer surface of one sleeve of the second elongated hollow member being adjacent to and substantially surrounded by at least a segment of the inner surface of one sleeve of the first elongated hollow member.

2. A composite metal article according to claim 1 wherein the cross section of at least one of said sleeves having a perimeter smaller than the perimeter of the other sleeve of the same member is circular.

3. A composite metal article according to claim 1 wherein the cross section of at least one of said sleeves having a perimeter smaller than the perimeter of the other sleeve of the same member is polygonal.

4. A composite metal article according to claim 1 wherein the cross section of at least one of said sleeves having a perimeter smaller than the perimeter of the other sleeve of the same member is semicircular.

5. A composite metal article according to claim 1 wherein the cross sections of all of said sleeves are circular.

6. A composite metal article according to claim 1 wherein said outer surface of said one sleeve of said second elongated hollow member adjacent to and substantially surrounded by at least a segment of said inner surface of said sleeve of first elongated hollow member is in substantial contact with said inner surface of said of said sleeve of first elongated hollow member.

7. An electroforming process comprising providing a first elongated electroforming mandrel and a second elongated electroforming mandrel, each of said mandrels having a first end and a second end and a substantially circumferential electroforming surface extending from about said first end along the length of each of the mandrels to substantially said second ends, the perimeter of said electroforming surface adjacent said first end of each of said mandrels being smaller than the perimeter of the remaining electroforming surface on each of said mandrels, the outside perimeter of at least one segment of said electroforming surface of said second elongated electroforming mandrel being sufficiently smaller than the inside perimeter of at least one segment of said electroforming surface of said first elongated electroforming mandrel whereby a hollow metal article electroformed on said second elongated electroforming mandrel is adapted to slide into the hollow interior of a hollow metal article electroformed on said first elongated electroforming mandrel, electroforming a hollow article on said electroforming surface of said first mandrel, electroforming a hollow article on said electroforming surface of said second mandrel, each of said articles corresponding to the electroforming surface of the respective mandrels, removing said hollow articles from said mandrels, and inserting at least a segment of said hollow article from said second elongated mandrel inside at least a segment of said hollow article from said first elongated mandrel whereby the outer surface of at least a segment of said hollow article from said second elongated mandrel is substantially surrounded by at least a segment of the inner surface of said hollow article from said first elongated mandrel.

8. An electroforming process according to claim 7 wherein the cross section of said remaining electroforming surface of said mandrels is circular.

9. An electroforming process according to claim 7 wherein the cross section of said remaining electroforming surface of said mandrels is polygonal.

10. An electroforming process according to claim 7 wherein the cross section of the electroforming surface adjacent said remaining electroforming surface of said mandrels is circular.

11. An electroforming process according to claim 7 wherein the cross section of the electroforming surface adjacent said remaining electroforming surface of said mandrels is polygonal.

12. An electroforming process according to claim 7 wherein the cross section of the electroforming surface adjacent said remaining electroforming surface of said mandrels is semicircular.

13. A composite metal article according to claim 1 wherein said outer surface of said one sleeve of said second elongated hollow member adjacent to and substantially surrounded by at least a segment of said inner surface of said sleeve of first elongated hollow member has a diameter less than about 0.0025 mm than the diameter of said inner surface of said sleeve of said first elongated hollow member.

14. A composite metal article according to claim 6 wherein said outer surface of said one sleeve of said second elongated hollow member adjacent to and substantially surrounded by at least a segment of said inner surface of said sleeve of first elongated hollow member is swaged against said inner surface of said sleeve of first elongated hollow member.

15. A composite metal article comprising a first electroformed elongated hollow member and a second electroformed elongated hollow member, each of said hollow members comprising at least a first sleeve and a second sleeve, said first sleeve of each of said hollow members having a perimeter smaller than the perimeter of said second sleeve of the same member, at least a segment of the outer surface of said second sleeve of one of said elongated hollow members being adjacent to, substantially surrounded by and swaged against at least a segment of the inner surface of said second sleeve of the other elongated hollow member, one of said first sleeves having a polygonal cross section and the other of said first sleeves having a circular cross section.

* * * * *